US008742824B2

(12) United States Patent
Nagumo

(10) Patent No.: US 8,742,824 B2
(45) Date of Patent: Jun. 3, 2014

(54) DRIVER CIRCUIT FOR DRIVING A ROW OF SWITCH ELEMENTS SUCH AS LIGHT EMITTING THYRISTORS, DRIVE APPARATUS INCORPORATING THE DRIVER CIRCUIT, AND IMAGE FORMING APPARATUS

(75) Inventor: Akira Nagumo, Gunma (JP)

(73) Assignee: Oki Data Corporation, Tokyo (JP)

( * ) Notice: Subject to any disclaimer, the term of this patent is extended or adjusted under 35 U.S.C. 154(b) by 639 days.

(21) Appl. No.: 12/929,383

(22) Filed: Jan. 20, 2011

(65) Prior Publication Data

US 2011/0181640 A1 Jul. 28, 2011

(30) Foreign Application Priority Data

Jan. 22, 2010 (JP) ..... 2010-011594

(51) Int. Cl.
*H03K 17/00* (2006.01)
*B41J 29/38* (2006.01)

(52) U.S. Cl.
USPC ..... 327/403; 347/9

(58) Field of Classification Search
USPC ..... 347/9; 257/99; 315/362; 327/403
See application file for complete search history.

(56) References Cited

U.S. PATENT DOCUMENTS

| | | | | |
|---|---|---|---|---|
| 2007/0057259 | A1 | 3/2007 | Nagumo | |
| 2009/0237483 | A1 | 9/2009 | Nagumo | |
| 2009/0295901 | A1 | 12/2009 | Nagumo | |
| 2010/0038671 | A1 * | 2/2010 | Kondoh | 257/99 |

FOREIGN PATENT DOCUMENTS

| | | | |
|---|---|---|---|
| JP | 09-199760 | A | 7/1997 |
| JP | 09-240057 | A | 9/1997 |
| JP | 2001-287393 | A | 10/2001 |
| JP | 2009-220535 | A | 10/2009 |

* cited by examiner

*Primary Examiner* — Alessandro Amari
*Assistant Examiner* — Carlos A Martinez
(74) *Attorney, Agent, or Firm* — Rabin & Berdo, P.C.

(57) ABSTRACT

A driver circuit is used for driving a plurality of switch elements connected between a power supply terminal and a common terminal. Each switch element includes an anode connected to the power supply terminal, a cathode, and a gate. The cathode is connected to a common terminal. The gate controls electrical conduction between the anode and the cathode. The driver circuit includes a switch circuit connected between the power supply terminal and the common terminal, and a driver into which a drive current flows. The switch circuit is in parallel with the switch elements, and electrically connects or disconnects the power supply terminal and the common terminal in response to a control signal supplied thereto. A transmission line, having a specific characteristic impedance, is connected between the common terminal and the driver circuit.

14 Claims, 11 Drawing Sheets

DRIVER CIRCUIT FOR DRIVING A ROW OF SWITCH ELEMENTS SUCH AS LIGHT EMITTING THYRISTORS, DRIVE APPARATUS INCORPORATING THE DRIVER CIRCUIT, AND IMAGE FORMING APPARATUS

BACKGROUND OF THE INVENTION

Field of the Invention

The present invention relates to a driver circuit for cyclically selectively driving a plurality of elements aligned in a row, e.g., light emitting thyristors as a light source for an electrophotographic printer or display elements for a displaying apparatus, a driving apparatus that employs the driver circuit, and an image forming apparatus that employs the driving apparatus.

Some existing image forming apparatus such as an electrophotographic printer employ an exposing unit in which a plurality of light emitting elements are aligned. The light emitting elements are, for example, three-terminal switch elements or light emitting thyristors having an anode, cathode, and a gate. A single driver circuit selectively drives the gates of light emitting thyristors, thereby causing current to flow from anode to cathode through specified light emitting thyristors to emit light.

One known print head using light emitting thyristors is a self-scanning light emitting print head disclosed in Japanese Patent Application Publication No. 2001-287393. This print head has a print head connected to a printer controller via a cable. The print head has arrays of light emitting thyristors and the printer controller has a driver circuit for driving the print head.

The print head includes light emitting arrays and a self-scanning circuit. The light emitting array includes a plurality of light emitting thyristors that have an anode connected to a power supply and a cathode connected to aground terminal. The self-scanning circuit provides a trigger signal to the gates of the respective light emitting thyristors. The driver circuit is constituted of CMOS inverters formed of CMOS transistors and current limiting resistors connected to the output of the CMOS inverters. The current limiting resistors are connected to the common terminal through the cable.

The above-described self-scanning print head operates as follows: Forward voltage is supplied to the light emitting thyristors through the current limiting resistors to a common terminal to which the anodes of the light emitting thyristors are connected. The self-scanning circuit provides a trigger signal to the gate of a corresponding light emitting thyristor to emit light, thereby causing the light emitting thyristor to emit light.

Existing self-scanning print heads suffer from the following drawbacks. When the driver circuit provides the drive current to the print head through the cable, the drive current may have a waveform distorted due to multiple reflections in the cable. This type of distortion occurs on the rising and falling edges of the drive current, causing changes in the effective pulse width of the drive current, and hence changes in exposure energy. The change in exposure energy causes uneven print density.

One way of alleviating the signal reflection is to select a cable having a specific characteristic impedance that matches the resistance of the current limiting resistor. However, cables on the market have their predetermined characteristic impedances and cannot be selected to meet individual circuit designs. On the other hand, the resistance of the current limiting resistor is selected in accordance with the supply voltage of the CMOS inverter and the anode-cathode voltage and drive current of the light emitting thyristor, and is about 200 ohms. Thus, the resistance of the current limiting resistor necessarily differs from the characteristic impedance of the cable, so that signal reflection occurs due impedance mismatching between the cable and the current limiting resistor. This leads to the problem of accurately controlling the amount of exposure energy.

SUMMARY OF THE INVENTION

An object of the invention is to solve the aforementioned prior art problems.

A driver circuit is used for driving a plurality of groups of switch elements connected between a power supply terminal and a common terminal. Each switch element includes an anode connected to the power supply terminal, a cathode, and a gate. The anode is connected to the power supply and the cathode connected to a common terminal. The gate controls electrical conduction between the anode and the cathode. The driver circuit includes a switch circuit connected between the power supply terminal and the common terminal, and a driver circuit into which drive current flows. The switch circuit is in parallel with the switch elements, and the switch circuit electrically connects or disconnects between the power supply terminal and the common terminal in response to a control signal supplied thereto. A transmission line having a specific characteristic impedance is connected between the common terminal and the driver circuit.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Image Forming Apparatus}

Figure 1:
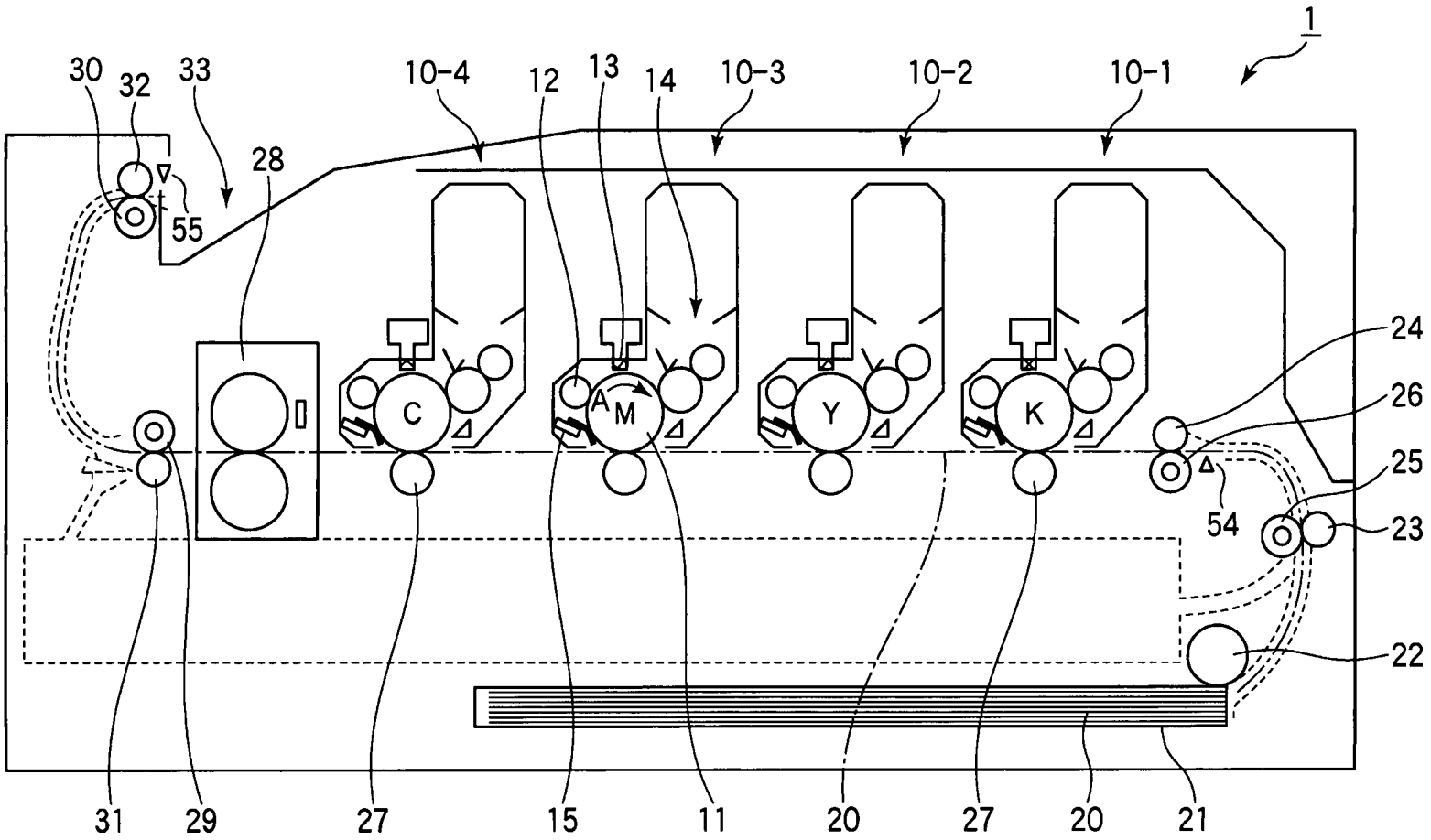
FIG. 1 illustrates the outline of an image forming apparatus according to a first embodiment.

FIG. 1 illustrates the outline of an image forming apparatus according to a first embodiment.

The image forming apparatus 1 is a tandem electrophotographic color printer incorporating a print head e.g., an optical print head that employs a driver apparatus for driving arrays of light emitting elements, e.g., three-terminal thyristors. The image forming apparatus 1 includes four process units 10-1 to 10-4 that form a black (K), a yellow (Y) image, a magenta (M) image, and a cyan (C) image, respectively. The four process units are aligned from upstream to downstream of the transport path of a recording medium, e.g., paper 20. Each of the process units may be substantially identical; for simplicity only the operation of the process unit 10-3 for forming cyan images will be described, it being understood that the other process units may work in a similar fashion.

The process unit 10-3 includes a photoconductive drum 11 rotatable in a direction shown by arrow A. A charging unit 12, an exposing unit, e.g., an optical print head 13, a developing unit 14, and a cleaning device 15 are disposed in this order around the photoconductive drum 11. The charging unit 12 charges the surface of the photoconductive drum 11. The exposing unit 13 selectively illuminates the charged surface of the photoconductive drum 11 to form an electrostatic latent image. The developing unit 14 deposits magenta toner to the electrostatic latent image formed on the photoconductive drum 11 to form a magenta toner image. The cleaning device 15 removes toner remaining on the photoconductive drum 11 after transferring the magenta toner image onto the paper 20. A drive source (not shown) drives the photoconductive drum 11 and a variety of rollers in rotation via a gear train.

A paper cassette 21, which holds a stack of paper 20 therein, is disposed at a lower portion of the image forming apparatus 1. A hopping roller 22 is disposed over the paper cassette 21, and feeds the paper 20 on a sheet-by-sheet basis into the transport path. A transport roller 25 cooperates with a pinch roller 24 to hold the paper 20 in a sandwiched relation. A registry roller 26 cooperates with a pinch roller 24 to correct the skew of the paper 20, and transports the paper 20 to the process unit 10-1. The transport roller 25 and registry roller 26 are disposed downstream of the hopping roller 22. A drive source (not shown) drives the hopping roller 22, transport roller 25, and registry roller 26 in rotation via a gear train.

Transfer units 27 are formed of, for example, a semi-conductive rubber material, and parallel the photoconductive drums 11 of the process units 10-1 to 10-4. When the toner images formed on the photoconductive drums 11 are transferred onto the paper 20, the transfer units 27 receive high voltages so as to create a potential difference across each transfer unit 27 and the surface of a corresponding photoconductive drum 11.

A fixing unit 28 is located downstream of the process unit 10-4, and includes a heat roller, which incorporates a heater therein, and a pressure roller. When the paper 20 passes through a fixing point defined between the pressure roller and the heat roller, the toner image on the paper 20 is fixed under heat and pressure. Discharge rollers 29 and 30, pinch rollers 31 and 32, and a paper stacker 33 are disposed downstream of the fixing unit 28. The discharge rollers 29 and 30 cooperate with the pressure rollers 31 and 32, respectively, to hold the paper 20 in a sandwiched relation, and transport the paper 20 to the paper stacker 33. The heat roller, pressure roller, and discharge rollers 29 and 30 are driven in rotation by a drive power transmitted from a drive source (not shown) via, for example, a gear train.

The image forming apparatus 1 operates as follows:

The hopping roller 22 feeds the paper 20 into the transport path from the paper cassette 21 on a sheet-by-sheet basis. The paper 20 is held by the transport roller 25, registry roller 26, and pinch rollers 23 and 24 in a sandwiched relation, and is transported into a transfer point defined between the photoconductive drum 11 of the process unit 10-1 and the transfer unit 27. As the photoconductive drum 11 rotates, the paper 20 is further transported through the transfer point so that the toner image on the photoconductive drum 11 is transferred onto the paper 20. Likewise, the paper 20 is transported through the remaining process units 10-2 to 10-4 so that the toner images of corresponding colors are transferred onto the paper 20 in registration.

When the paper 20 passes through the fixing unit 28, the toner images carried on the paper 20 are fixed. The paper 20 is further transported by the discharge rollers 29 and 30 and pinch rollers 31 and 32 to the paper stacker 33 defined on the outer wall of the image forming apparatus 1. This completes printing.

{Construction of Optical Print Head}

Figure 2:
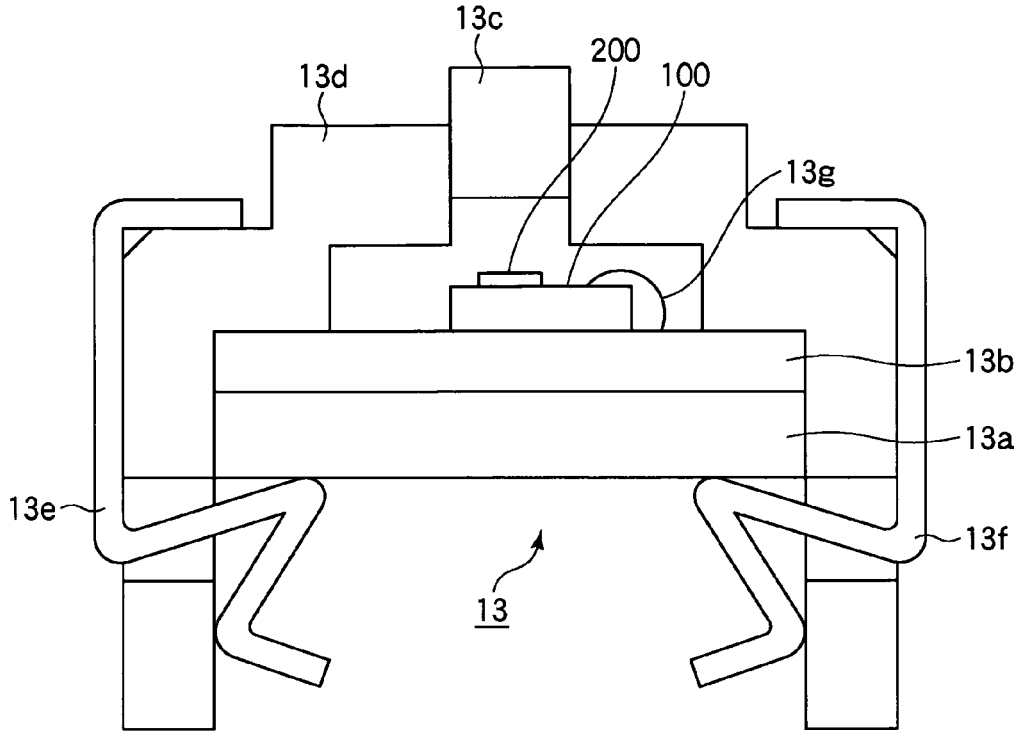
FIG. 2 is a cross-sectional view of an optical print head shown in FIG. 1.
Figure 3:
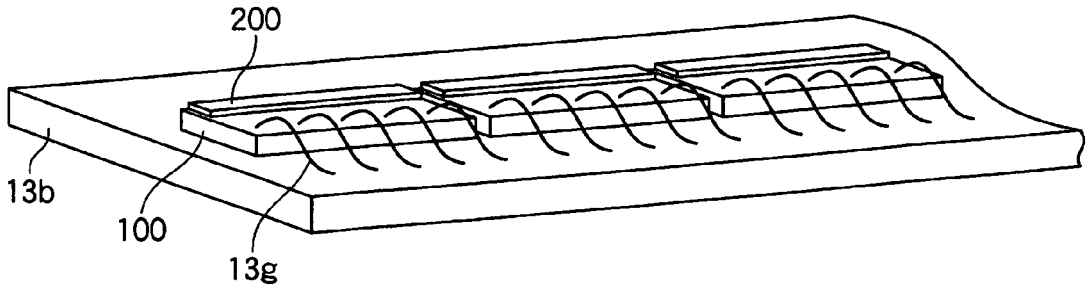
FIG. 3 is a perspective view of a circuit board shown in FIG. 2.

FIG. 2 is a cross-sectional view of the optical print head 13 shown in FIG. 1. FIG. 3 is a perspective view of a circuit board 13*b* shown in FIG. 2.

The optical print head 13 includes a base 13*a* and the circuit board 13*b* shown in FIG. 3 mounted on the base 13*a*. The circuit board includes the printed circuit board 13*b* fixed on the base 13*a*, a plurality of integrated circuit (hereinafter IC) chips that incorporates integrated shift registers and is bonded to the printed circuit board 13*b* by means of an adhesive, arrays of light emitting elements incorporating a row of light emitting elements e.g., light emitting thyristors bonded to the IC chips by means of an adhesive. The arrays 200 of light emitting elements and the respective IC chips 100 are electrically connected to each other by means of thin film wirings (not shown). A plurality of terminals of the IC chips 100 and wiring pads (not shown) on the printed circuit board 13*b* are electrically connected by means of bonding wires 13*g*.

A lens array 13*c* (e.g., rod lens array) is constituted of a plurality of column-shaped optical elements and is disposed above a plurality of light emitting arrays 200. The rod lens array 13*c* is fixedly supported by a holder 13*d*. The base 13*a*, printed circuit board 13*b*, and holder 13*d* are clamped firmly together by means of clamp members 13*e* and 13*f*.

{Printer Controller}

Figure 4:
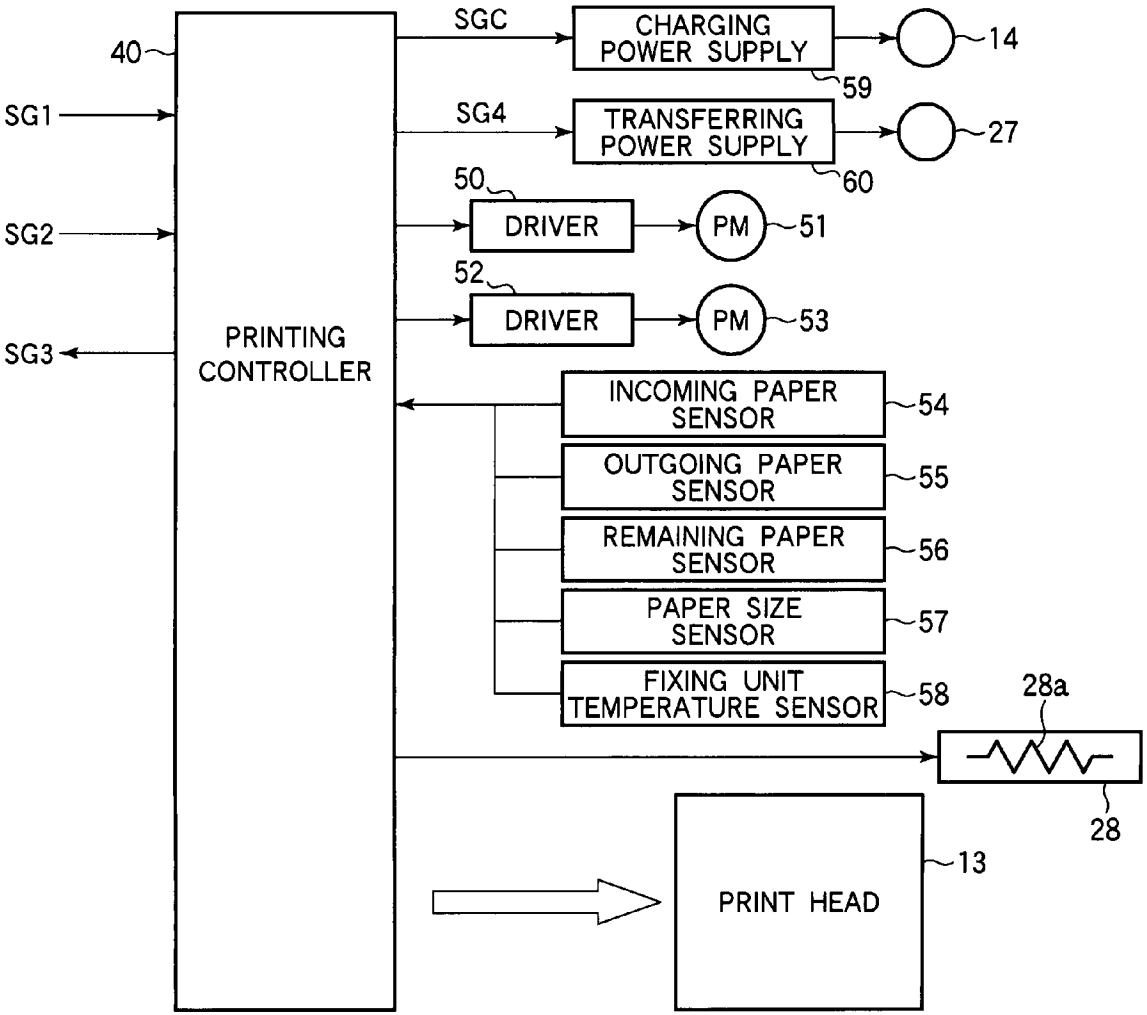
FIG. 4 is a block diagram illustrating the configuration of a printer controller for use with the image forming apparatus shown in FIG. 1.

FIG. 4 is a block diagram illustrating the configuration of a printer controller for use with the image forming apparatus 1 shown in FIG. 1.

The printer controller includes a printing controller 40 located in a print engine of the image forming apparatus 1. The printing controller 40 mainly includes a microprocessor, a read only memory (ROM), a random access memory (RAM), an input/output port, and a timer. The printer controller receives a control signal SG1 and a video signal (bit map data) SG2 from an image processing section (not shown)

to perform sequential control of the overall operation of the image forming apparatus 1, thereby performing printing. The printing controller 40 is connected to the four optical print heads 13 of the process units 10-1 to 10-4, a heater 28*a* of the fixing unit 28, drivers 50 and 52, an incoming paper sensor 54, an outgoing paper sensor 55, a remaining paper sensor 56, a paper size sensor 57, a fixing unit temperature sensor 58, a high voltage charging power supply 59, and a high voltage transferring power supply 60. The driver 50 is connected to a developing/transferring process motor (PM) 51. The driver 52 is connected to a paper transporting motor (PM) 53. The high voltage charging power supply 59 is connected to the developing unit 14. The high voltage transferring power supply 60 is connected to transfer units 27.

The printing controller 40 operates as follows:

Upon reception of the control signals SG1 to command printing from the image processing section, the printing controller 40 determines by means of the temperature sensor 58 whether the heat roller in the fixing unit 28 is in a usable temperature range. If the temperature is lower than the usable temperature range, the printing controller 40 supplies electric power to the heater 28*a* to heat the heat roller to the usable temperature. The printing controller 40 then causes the driver 50 to rotate the developing/transfer process motor 51, and outputs a charging signal SGC to turn on the high voltage charging power supply 59, thereby charging the developing unit 14.

The remaining paper sensor 56 detects whether the paper 20 is present in the paper cassette and the paper size sensor 57 detects the size of the paper 20. The paper 20 of the right size is then fed to the transport path. The paper transporting motor 53 is coupled to a planetary gear assembly (not shown) and is adapted to rotate in the forward and reverse directions. Switching the rotation direction of the paper transporting motor 53 allows switching of the rotation directions of the transport rollers 25, depending on the size of the paper 20. When printing on one page of paper is started, the paper transporting motor 53 is first rotated in the reverse direction, thereby transporting the paper 20 by a predetermined amount until the incoming paper sensor 54 detects the paper 20. The paper transporting motor 53 is then rotated in the forward direction to transport the paper 20 into the print engine of the image forming apparatus 1.

When the paper 20 arrives a position where printing can be performed, the printing controller 40 provides a timing signal SG3 including a main scanning sync signal and a sub scanning sync signal to an image processing section (not shown), and receives the video signal SG2. The video signal SG2 is edited on a page-by-page basis in the image processing section and is received by the printing controller 40. The video signal SG2 is transferred as print data signals HD-DATA3 to HD-DATA0, which are supplied to the respective optical print heads 13. Each of the optical print heads 13 incorporates a plurality of light emitting thyristors, each thyristor forming a dot or pixel of an image.

The video signal SG2 is transmitted and received on a line-by-line basis. The optical print head 13 illuminates the negatively charged surface of the photoconductive drum 11 to form an electrostatic latent image formed of dots. The dots have an increased potential due to exposure to light. The toner is negatively charged in the developing unit 14 and is then attracted to the dots formed on the photoconductive drum 11 by the Coulomb force, thereby forming a toner image.

The toner image on the photoconductive drum 11 is then transported to the transfer point defined between the photoconductive drum 1 and the transfer unit 27. A transfer signal SG4 causes the high voltage transfer power supply 60 to turn on, thereby transferring the toner image onto the paper 20 as the paper 20 passes through the transfer point defined between the photoconductive drum 11 and the transfer unit 27. The paper 20 carries the toner image thereon and passes through the fixing point defined between the heat roller and pressure roller of the fixing unit 28, so that the toner image is fixed under heat and pressure. The paper 20 is then further transported past the outgoing paper sensor 55.

In response to the detection signals from the paper size sensor 48 and incoming paper sensor 57, the printing controller 40 causes the high voltage transfer power supply 60 to turn on to apply the high voltage to the transfer unit 27 while the paper 20 is passing through the transfer point. When the paper 20 has passed the outgoing paper sensor 55 after completion of printing, the printing controller 40 causes the high voltage charging power supply 59 to stop applying the high voltage to the developing section 14, and the developing/transferring process motor 51 to stop rotating. The above-described operation is repeated for each page until the entire print data has been printed.

{Print Controller and Print Head}

Figure 5:
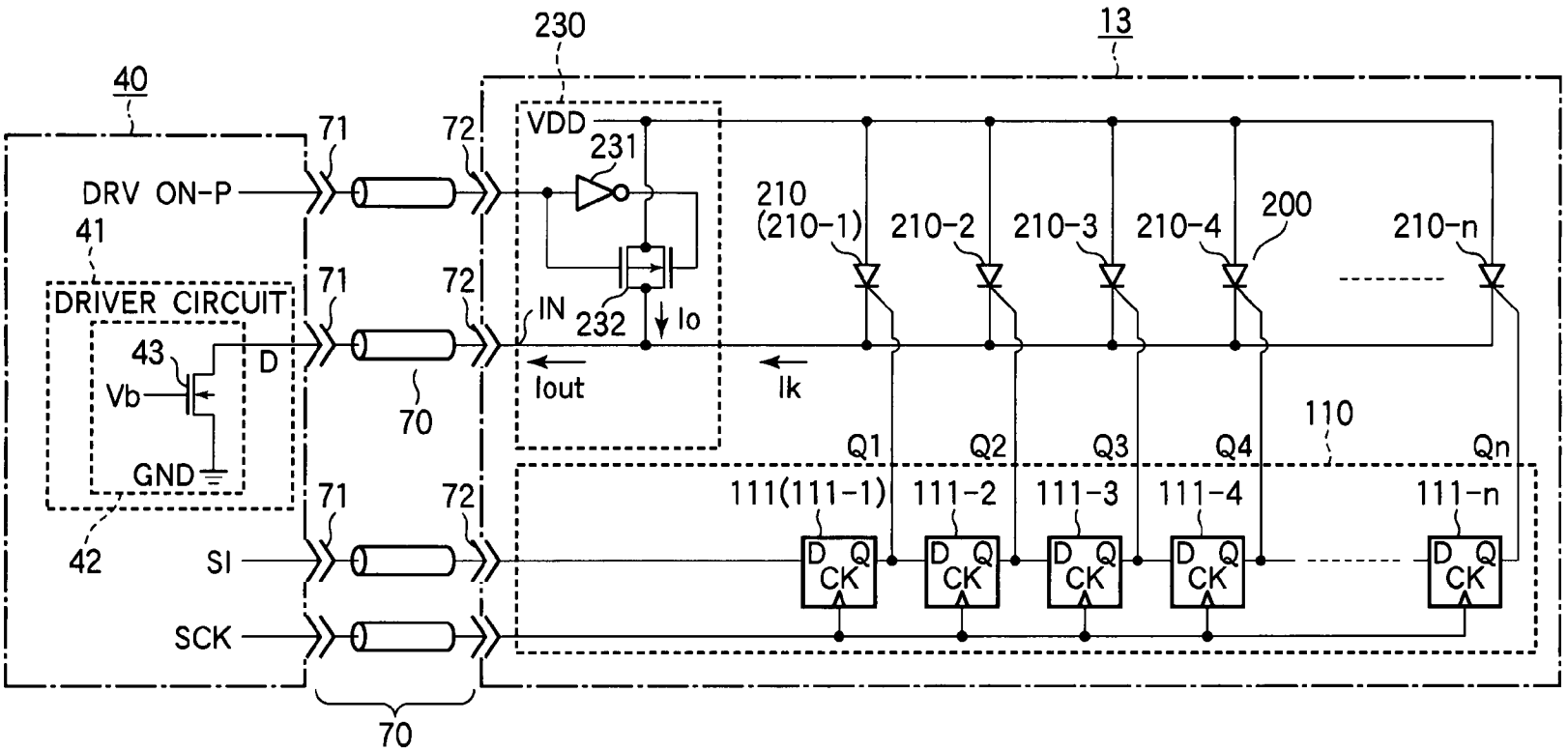
FIG. 5 illustrates the circuit configuration of a printing controller and the print head shown in FIG. 4.

FIG. 5 illustrates the circuit configuration of the printing controller 40 and the print head 13 shown in FIG. 4.

The printing controller 40 and print head 13 are electrically connected by means of cables 70. The cables 70 have connectors 71 connected to the printing controller 40 and connectors 72 connected to the print head 13, and can be any type of transmission line with a specific impedance including a coaxial cable and twisted pair.

The print head 13 includes a shift register 110 formed in the IC chips 100, arrays 200 of light emitting elements, and a switching means (e.g., switch circuit) 230.

The shift register 110 includes a plurality of flip-flops (hereinafter referred to as FF) FF 111-1 to FF 111-n, and outputs trigger signals (e.g., trigger current) to the arrays of light emitting elements to turn on or off the light emitting elements. Each FF 111 has an input terminal D through which data is inputted, an output terminal Q through which an output is outputted, and a clock terminal CK through which a serial clock signal SCK is inputted. Serial data SI is inputted into the input terminal D of the first stage FF 111-1 and the output terminal Q of the FF 111-1 is connected to the input terminal D of the second stage FF 111-2. Likewise, the remaining flip-flops are cascaded. When the printing controller 40 sends the serial clock SCK and serial data SI to the register 110 via the cable 70 and connectors 71 and 72, the shift register 110 shifts the received data from the first stage FF 111-1 to the last stage FF 111-n on the serial clock SCK, thereby outputting outputs from the output terminals Q1 to Qn.

The shift register 110 is fabricated on a silicon wafer substrate using, for example, CMOS technology but may be fabricated on a glass substrate using known thin film transistor (TFT) technology.

The array 200 of light emitting elements has a plurality of light emitting thyristors 210-1 to 210-n, each light emitting thyristor having a first terminal or anode connected to the power supply VDD, a second terminal or cathode connected to a common terminal IN, and a third terminal or gate connected to a corresponding one of the output terminals (Q1-Qn) of the shift register 110. When the power supply voltage VDD is applied across the anode and cathode of the light emitting thyristor, if trigger current flows into the gate, the thyristor conducts so that the cathode current Ik flows from anode to cathode to emit light. If printing is to be performed on A4 size paper at a resolution of 600 dpi, the print head 13 employs a total of 4992 light emitting thyristors.

The switch circuit 230 connects or disconnects between a VDD terminal and the common terminal IN upon a positive logic ON/OFF command signal DRVON-P ("P" implies positive logic). The switch circuit 230 includes an inverter 231 and a transmission gate 232. The inverter 231 outputs an inverted ON/OFF command signal DRVON-P. The transmission gate 232 connects or disconnects between the VDD terminal and the common terminals IN upon the output signal of the inverter 231. The transmission gate 232 includes a PMOS transistor and an NMOS transistor. The PMOS transistor becomes ON or OFF depending on the state of the ON/OFF command signal DRVON-P applied to the gate. The NMOS transistor becomes ON or OFF depending on the state of the output signal of the inverter 231 applied to the gate. The PMOS transistor and NMOS transistor are connected in parallel between the VDD terminal and the common terminal IN. When the transmission gate 232 is ON, current Io flows therethrough.

The printing controller 40 includes a circuit (not shown) that supplies the serial data SI and the serial clock SCK to the print head 13, a plurality of driver circuits 41 that drive the arrays 200 of light emitting elements in a time division manner, a power supply terminal, and a ground terminal. Only one of the driver circuits 41 is shown in FIG. 5. The arrays 200 of light emitting elements include a total of 4992 light emitting thyristors. The 4992 light emitting thyristors are grouped into a plurality of groups, each group being driven by a corresponding driver circuit 41 simultaneously.

The following is a typical design. A total of 26 array chips are aligned on the print circuit board 13*b*, each array chip having 192 light emitting thyristors 21 (210-1 to 210-192). Thus, the print head 13 has a total of 4992 (=26×192) light emitting thyristors. The driver circuit 41 has 26 output terminals connected to corresponding arrays 200 of light emitting elements. The driver circuit 41 resides within the printer controller 40 shown in FIG. 5. Instead, the driver circuit 41 may also be in the print head 13, in which the cables 70 can be eliminated. However, the print head 13 has a specific length corresponding to the size of print medium (e.g., A4 size paper or A3 size paper) and has a print circuit board having a length corresponding to the size of print medium. Signal paths formed on a print circuit board may also have specific characteristic impedances, and signal reflection may occur if the signal paths are formed without considering characteristic impedances thereof.

The driver circuit 41 includes a drive source in the form of, for example a constant current circuit 42. The constant current circuit 42 has an NMOS transistor 43 that operates in its saturation region. In other words, the NMOS transistor 43 has a gate to which a bias voltage Vb is applied, a drain connected to the data terminal D, and operates in its saturation region to supply the drive current Iout to the data terminal D. The data terminal D is connected to the common terminal IN of the print head 13 through the connector 71, the cable 70, and the connector 72.

{Thyristors}

FIGS. 6A-6D illustrate light emitting thyristor 210 shown in FIG. 5.

Figure 6A:
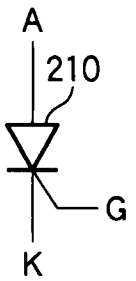
FIGS. 6A-6D illustrate a light emitting thyristor shown in FIG. 5.

Referring to FIG. 6A, the light emitting thyristor 210 includes an anode A, a cathode K, and a gate G.

Figure 6B:
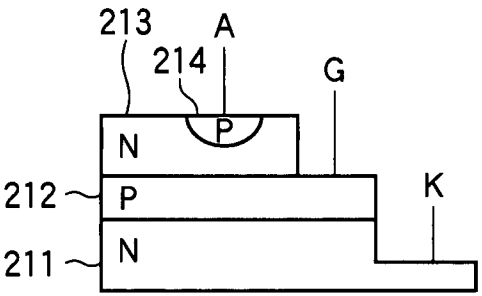

FIG. 6B is a cross-sectional view of the light emitting thyristor 210. The light emitting thyristor 210 is fabricated by, for example, epitaxially growing a predetermined crystal on a GaAs wafer by known metal organic chemical vapor deposition (MO-CVD).

First, a predetermined sacrificial layer and a buffer layer (not shown) are epitaxially grown on a wafer substrate, and a three-layer structure is then fabricated. The three-layer structure includes an N-type layer 211 that contains an N-type impurity, a P-type layer 212 that contains a P-type impurity, and an N-type layer 213 that contains an N-type impurity, layered in this order. A P-type impurity region 214 is then selectively formed in the uppermost N-type layer 213 by photolithography. Grooves are formed in the wafer to define individual devices by a known etching technique. When etching is performed, a part of the N-type layer 213, which is the uppermost layer of the light emitting thyristor 210, is etched to expose. A metal wiring is formed on the exposed region to form the electrode for a cathode K. The electrodes for the anode A and the gate G are also formed on the P-type impurity region 214 and the N-type layer 212, respectively.

Figure 6C:
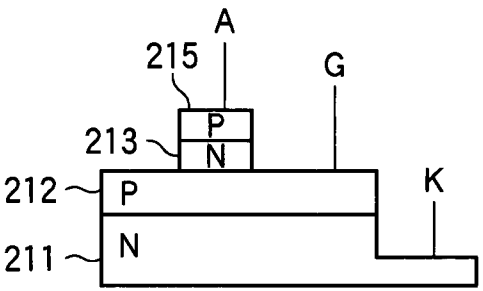

FIG. 6C illustrates another example of the light emitting thyristor 210 which is fabricated by epitaxially growing a predetermined crystal on a GaAs wafer by known MO-CVD.

First, a predetermined sacrificial layer and a buffer layer (not shown) are exitaxially grown on a wafer substrate and a PNPN four-layer structure is then fabricated. The four-layer structure includes an N-type layer 211 that contains an N-type impurity, a P-type layer 212 that contains a p-type impurity, an N-type layer 213 that contains an N-type impurity, and a P-type layer 215 that contains a P-type impurity, layered in this order. Grooves are formed in the structure to define individual devices by a known etching technique. When etching is performed, apart of the N-type 211, which is the lowest layer of the light emitting thyristor 210, is exposed. Likewise, a part of the P-type layer 215, which is the uppermost layer, is exposed. A metal wiring is formed on the exposed region of the P-type layer 215 to form the anode A. At the same time, the gate G is formed on the N-type layer 212.

Figure 6D:
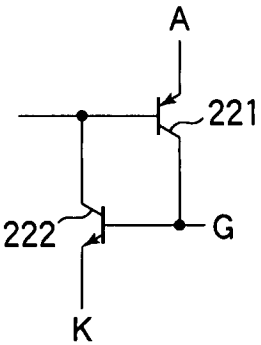

As is clear from FIG. 6D, the light emitting thyristor 210 is constituted of a PNP transistor 221 and an NPN transistor 222. The emitter of the PNP transistor 221 corresponds to the anode A of the light emitting thyristors 210 and the base of the PNP transistor 222 corresponds to the gate G. The gate electrode is also connected to the collector of the NPN transistor 222. The collector of the PNP transistor 221 is connected to the base of the NPN transistor 222. The emitter of the NPN transistor 222 corresponds to the cathode K of the light emitting thyristor 210.

The light emitting thyristor 210 shown in FIGS. 6A-6D has an AlGaAs layer formed on a GaAs wafer. The thyristor 210 is not limited to this configuration. The thyristor 210 may have a layer of GaP, GaAsP, or AlGaInP formed on the GaAs wafer or a GaN, AlGaN, or InGaN layer formed on a sapphire substrate.

Using epitaxial film bonding, the thyristor 210 shown in FIGS. 6B and 6C may be bonded to a wafer on which a plurality of driver ICs 100 having a shift register 110 are integrated. Using photolithography, interconnections are formed to connect the terminals of the shift register 110 to the terminal areas of the light emitting thyristors 210. The wafer is then diced into individual chips of driver ICs by a known dicing technique, thereby obtaining a composite chip that includes the IC chips 100 and arrays 200 of light emitting thyristors.

{Comparative Example of Print Head and Printing Controller}

Figure 7:
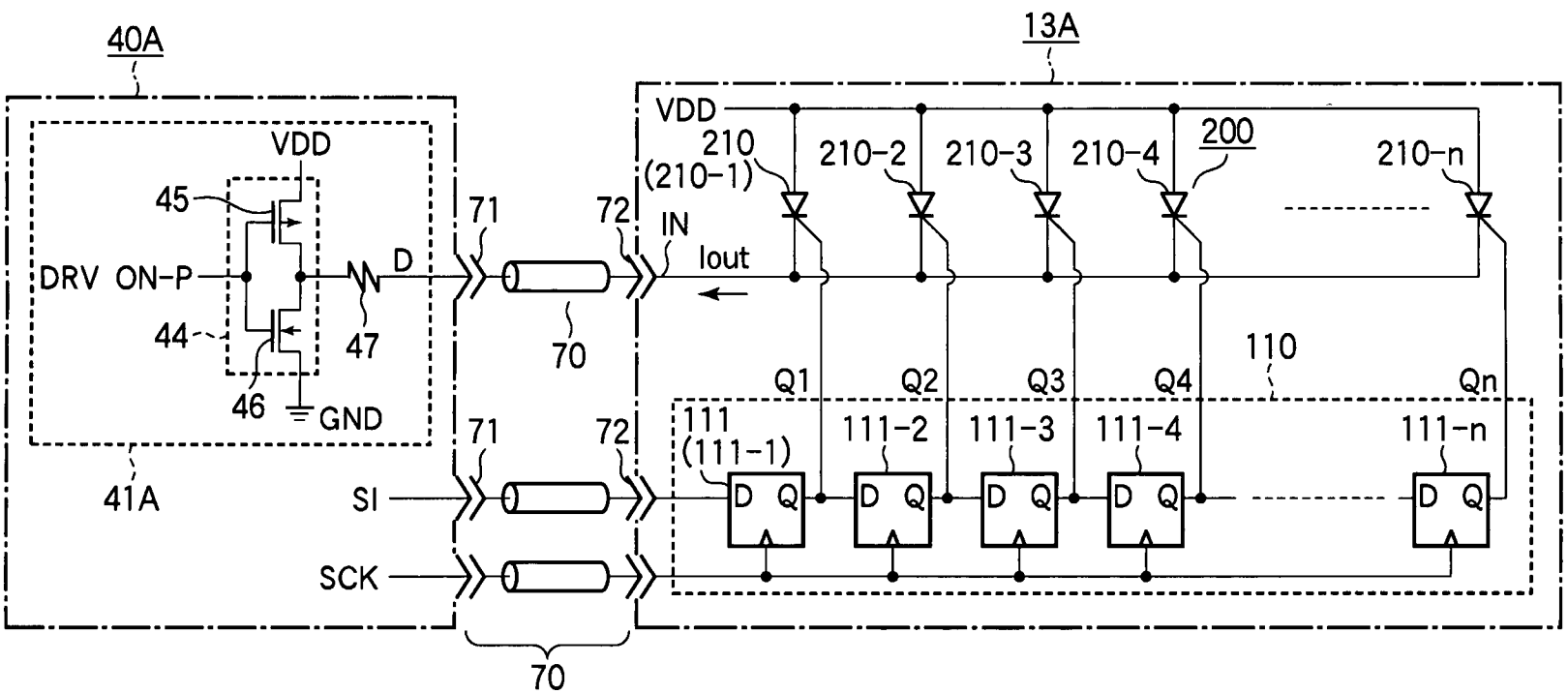
FIG.7 CONVENTIONAL ART
FIG. 7 illustrates a comparative example of a print head and a printer controller in the prior art.

FIG. 7 illustrates a comparative example of a print head and a printer controller in the prior art. Elements similar to those shown in FIG. 5 have been given common reference characters.

The configuration and operation of a print head 13A and a printer controller 40A in the comparative example shown in FIG. 7 will be described.

The printing controller 40A controls the print head 13A. The print head 13A has the shift register 110 and array 200 of light emitting elements just as in the print head 13 but has not the switch circuit 230. The printing controller 40A has a driver circuit 41A different from the driver circuit 41 of the first embodiment.

The driver circuit 41A is constituted of an inverter 44 and a current limiting resistor 47. The inverter 44 includes a PMOS transistor 45 and an NMOS transistor 46. The PMOS transistor 45 and NMOS transistor 46 are connected in series between the VDD terminal and the ground GND. The inverter 44 inverts the ON/OFF command signal DRVON-P, and has an output connected to the data terminal D via the resistor 47. The data terminal D is connected to the common terminal IN on the print head 13 side through the cable 70 and connector 72 just as in the first embodiment.

For example, when the ON/OFF command signal DRVON-P is at the Low level, the PMOS transistor 45 of the driver circuit 41A is ON and the NMOS transistor 46 of the driver 41A is OFF so that the output of the inverter 44 is at the High level. The output of the inverter 44 is connected to the data terminal D via the resistor 47. The data terminal D is connected to the common terminal IN of the print head 13A via the connector 71, cable 70, and connector 72 just as in the first embodiment. The potential at the data terminal D rises to a value substantially equal to the supply voltage VDD through the resistor 47. This causes the potential at the common terminal IN on the print head 13A side to rise to a value substantially equal to the supply voltage VDD via the connector 71, cable 70, and connector 72. As a result, the anode-cathode voltage of the light emitting thyristors 210-1 to 210-n of the array 200 of light emitting elements will become substantially zero volts, thereby turning off the light emitting thyristors 210-1 to 210-n. At this moment, the current flowing through the common terminal IN also decreases to zero. Thus, none of the light emitting thyristors 210-1 to 210-n are turned on.

When the ON/OFF command signal DRVON-P is at the High level, the PMOS transistor 45 is OFF and the NMOS transistor 46 is ON, so that the output terminal of the inverter 46 is at the Low level. The potential at the data terminal D becomes equal to the ground potential (i.e., 0 volts through the resistor 47, and the potential at the common terminal IN on the print head 13A becomes 0 volts through the connector 71, cable 70, and connector 72. As a result, the anode-cathode voltage of the light emitting thyristor 210 becomes substantially equal to the supply voltage VDD. At this moment, the output terminal (e.g., Q1) of the shift register 110 becomes the High level if a corresponding light emitting thyristor is to be turned on. Thus, trigger current flows through the gate of the thyristor 210-1, thereby causing the light emitting thyristor 210-1 to turn on. As a result, the drive current Iout flows from the cathode of the light emitting thyristor 210-1 to the data terminal D of the driver circuit 41A through a current path defined by the common terminal IN, connector 72, cable 70, and connector 71. The light output is determined by the magnitude of the drive current Iout.

The drive current Iout may be calculated as follows:

$$Iout=(VDD-Vf)/R \quad (1)$$

where VDD is the power supply voltage, Vf is the anode-cathode voltage of a light emitting thyristor being turned on (e.g., 210-1), and R is the resistance of the resistor 47. The ON voltage (VoL) of the NMOS transistor 46 can be neglected for simplicity.

Rewriting equation (1), we obtain the following relationship.

$$R=(VDD-Vf)/Iout \quad (1)$$

For example, the resistance R will be as follows:

$$R=(3.3-1.7)/8\times10^{-3}=200 \text{ ohms}$$

where VDD=3.3 V, Vf=1.7 V, and Iout=8 mA.

The resistor 47 is used to set the drive current of the light emitting thyristor and is almost automatically determined by VDD, Vf, and Iout.

Meanwhile, the characteristic impedance of the cable 70 is a function of the dielectric constant of the dielectric material, the shape of cross section, and the ratio of the external diameter of the inner conductor to the internal diameter of the outer conductor, and has a specific value such as 50 ohms, 75 ohms, or 100 ohms depending on the material. Therefore, the characteristic impedance of the cable 70 cannot be set at will independently of the resistor 47.

The driver circuit 41A has an output impedance substantially equal to the resistance R (e.g., 200 ohms) of the resistor 47 while the characteristic impedance of the cable 70 is, for example, 50 ohms. Thus, impedance mismatching occurs between the cable 70 and the output impedance of the driver circuit 41A. The problem of signal reflection due to impedance mismatching will be described below.

Figure 8A:
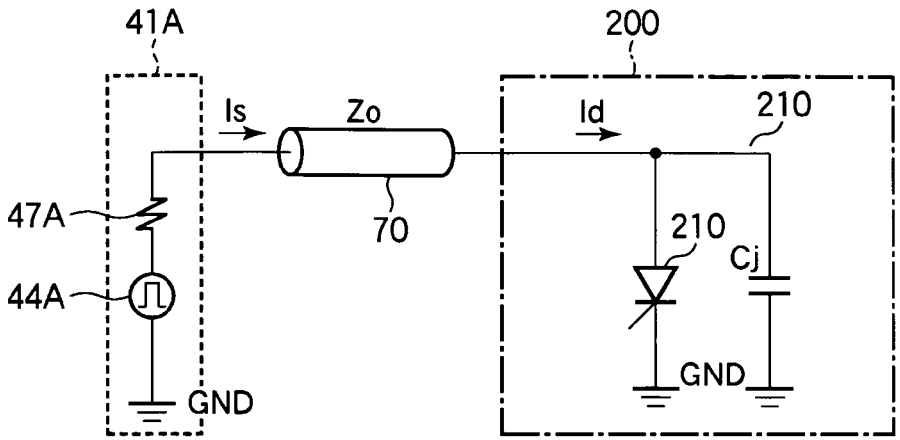
FIG. 8A is an equivalent circuit of a driver circuit and the light emitting thyristor.
Figure 8B:
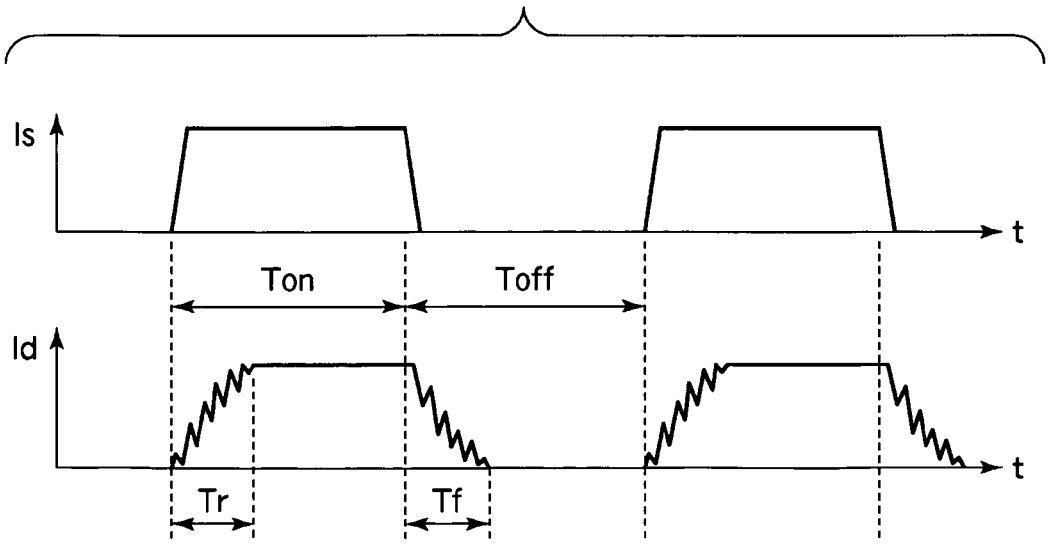
FIG. 8B illustrates the current waveforms.

FIG. 8A is an equivalent circuit of the driver circuit 41A and the light emitting thyristor 200. FIG. 8B illustrates the current waveforms.

Referring to FIG. 8A, the driver circuit 41A is constituted of a drive source 44A corresponding to the inverter 44 and an output resistor 47A corresponding to the current limiting resistor 47. Current Is flows through the output resistor 47A. The cable 70 has a characteristic impedance Zo, and a delay time Td. The light emitting thyristor 210 has a junction capacitance Cj across the anode and cathode. Current Id flows through the light emitting thyristor 210. FIG. 8A differs from FIGS. 5 and 7 in that the anode is connected to the cable 70 and the cathode is connected to the ground GND. However, the circuit shown in FIG. 7 is equivalent to that shown in FIG. 5 as long as high frequency characteristics are concerned.

FIG. 8B plots time t as the abscissa and current Is and current Id as the ordinate. Ton denotes the ON time of the driver circuit 44A. Toff denotes the OFF time of the driver circuit 44A.

Tr denotes the rise time of the current Id and Tf denotes the fall time of the current Id.

Referring to FIG. 8A, the delay time Td of the cable 70 is given as follows:

$$Vo = \frac{Co}{\sqrt{Er}} \quad (3)$$

$$Td = \frac{L}{Co}\sqrt{Er} \quad (4)$$

where L is the length of the cable 70, Vo is the propagation velocity, Co is the speed of light in vacuum and is equal to about $3\times10^8$ m/s, Er is a relative dielectric constant of the insulating material of the cable 70.

Assume that the insulating material has a relative dielectric constant of 4, and the cable 70 has a length of 1 m. The Td is given from equation (4) as follows:

$$Td = \frac{1}{3\times10^8}\sqrt{4} = 6.7 \text{ ns}$$

Referring to FIG. 8B, once the current Is outputted from the driver source 44A has risen, the current Id outputted from the cable 70 arrives at the light emitting thyristor after the delay time Td, and begins to rise. At this moment, the light emitting thyristor 210 acts as a capacitor (junction capacitor Cj) which in turn causes reflection of signal so that a reflection wave travels toward the driver source 44A through the cable 70. The reflected wave is again reflected by the internal impedance of the driver source 44A, and travels back toward the light emitting array 200 again through the cable 70.

When the wave reflected by the junction capacitor Cj reaches the driver circuit 41A, reflection of signal occurs due to the impedance mismatching between the characteristic impedance Zo of the cable 70 and the output resistance 47A, the mismatching causing another reflection of signal.

As a result, the current Id is distorted at its rising edge and falling edge, having a waveform different from the current Is. This leads to the change in the pulse width of the current Is (FIGS. 8A and 8B), which in turn causes the change in exposure energy applied to the photoconductive drum 11 of the image forming apparatus 1 shown in FIG. 1. The change in exposure energy causes uneven density in a printed image.

Reflection of signal may also present a problem in achieving high speed operation of the light emitting thyristors. This problem will be described further.

Referring to FIG. 8B, the current Id has ripples having a period of 2×Td at its rising edge. Therefore, the current Id rises in rise time Tr due to multiple reflections that occur between the drive source 44A and the light emitting thyristor 210 through the cable 70. In other words, even though the current Is rises up sharply, the current Id does not sharply rise.

The amount of reflection gradually decreases as the reflected wave propagates through the cable 70 repetitively in the forward and backward directions. Assume the reflected components will decay completely after the reflected wave propagates 10 times back and forth through the cable 70. The rise time Tr of the current Id is given as follows:

$$Tr = 2\times Td\times10 \approx 6.7\times20 = 134 \text{ ns}$$

The same is true for the falling time Tf of the current Id.

The rise time Tr of the current Id is much larger than the rise time of the current Is. The rise time Tr is determined mainly by the delay time Td of the cable 70 or the length of the cable 70. In order to improve the switching speed of the print head 13A, the cable 70 must be short.

However, the length L of the cable 70 is restricted by arrangement of components in the image forming apparatus 1. For example, the four process units 101-1 to 10-4 for black (K), yellow (Y), magenta (M), and cyan (C) are aligned in order in a tandem electrophotographic color printer. Therefore, the cables 70 that connect the printing controller 40 and the print heads 13 of the four process units 101-1 to 10-4 have different lengths. The longest cable could be longer than 1 m. As a result, the rise time Tr and fall time Tf of the current Id increase, which is an obstacle to high speed operation of the print head 13A.

Reflection of signal may be alleviated by improving the impedance matching between the characteristic impedance of the cable 70 and the output resistance 47A of the drive source 44A. However, they are determined by different factors and are difficult to be matched.

The configuration of the comparative example presents a problem in that uneven print density occurs due to uneven amounts of exposure energy resulting from reflection of signal, and a problem in that the switching speed of the light emitting thyristors cannot be increased due to the fact that the rise and fall times of the current Id are significantly long. Thus, a need exists for a solution for the above-described problems. The present invention provides the configuration shown in FIG. 5, thereby solving the problem.

{Brief Description of Operation of Printing Controller and Print Head}

Referring to FIG. 5, when the ON/OFF command signal DRVON-P is at the Low level, the output of the inverter 231 is at the High level, causing the PMOS and NMOS transistors of the transmission gate 232 to become ON.

This establishes a current path formed of the VDD terminal-transmission gate 232-common terminal IN-connector 72-cable 70-connector 71-data terminal D-and constant current source circuit 42.

At this moment, the cathode current Ik is zero and the drive current Iout that flows into the constant current source circuit 42 in the driver circuit 41 is equal to the current Io that flows through the transmission gate 230. Since the cathode current Ik is zero, the light emitting thyristor do not emit light.

When the ON/OFF command signal DRVON-P is at the High level, the output of the inverter 231 in the switch circuit 230 is at the Low level, and the PMOS and NMOS transistors of the transmission gate 232 are off. This breaks the current path formed of the VDD terminal-transmission gate 232-common terminal IN-connector 72-cable 70-connector 71-data terminal D-and constant current source circuit 42.

The shift register 110 provides a trigger signal of the High level to the gate of a corresponding light emitting thyristor, and the light emitting thyristor turns on. This establishes a current path formed of the VDD terminal-anode-cathode-common terminal IN-connector 72-cable 70-connector 71-data terminal D-and constant current source circuit 42. Thus, the cathode current Ik flows through the light emitting thyristor and enters as the current Iout into the driver circuit 41.

{Detailed Operation of Printing Controller and Print Head}

Figure 9:
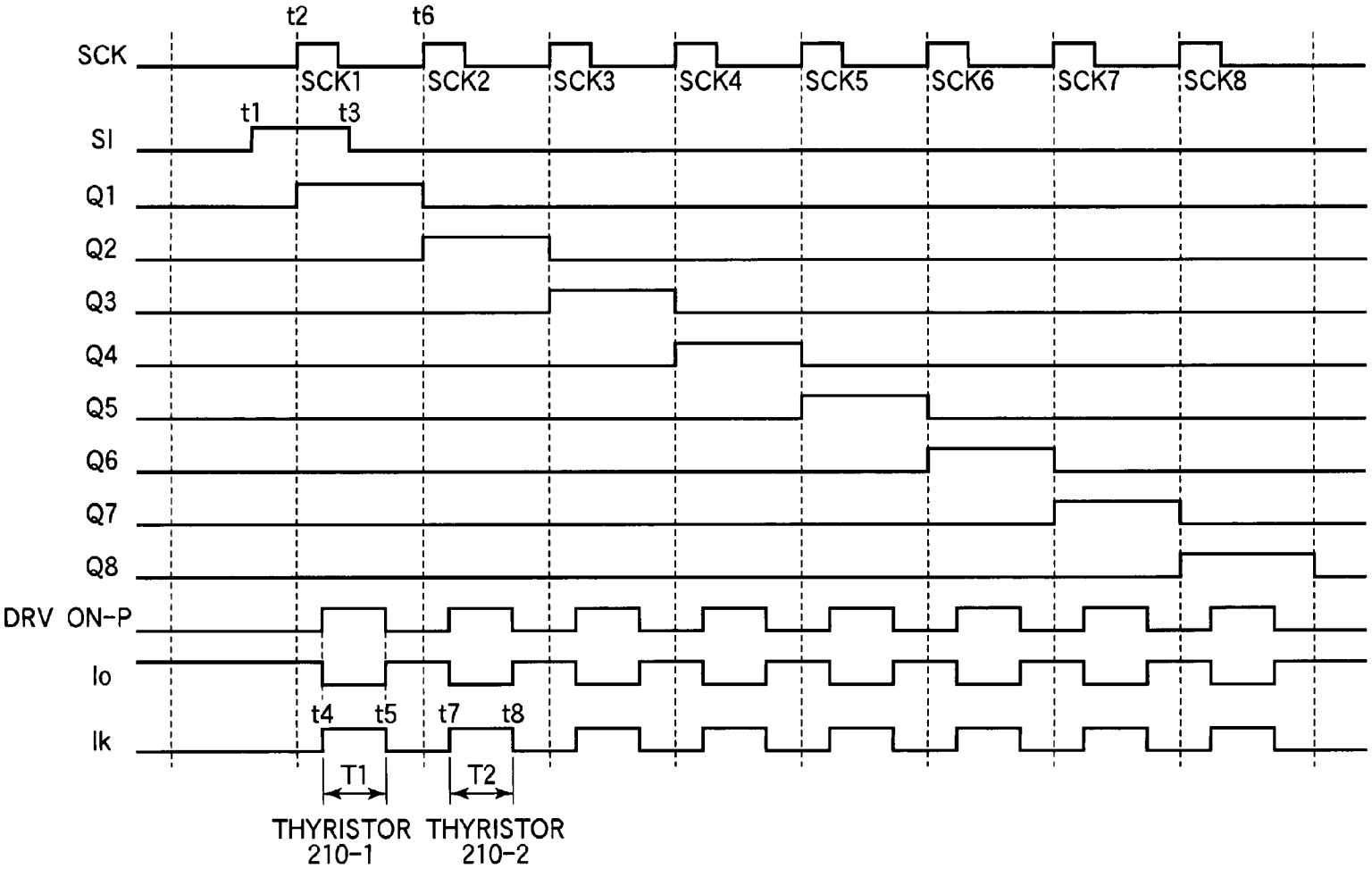
FIG. 9 is a timing chart illustrating the details of the operation of the printing controller and, print head.

FIG. 9 is a timing chart illustrating the details of the operation of the printing controller and print head.

FIG. 9 illustrates the waveform of respective signals when the light emitting thyristors 210-1 to 210-n (e.g., n=8) are turned on alternately one at a time in a single scanning line when the image forming apparatus 1 is printing.

The shift register 110 shown in FIG. 5 is first reset upon power-up of the image forming apparatus 1. The serial data SI is set to the Low level, and the shift register 110 receives clock pulses of the serial clock SCK equal in number to the stages of the shift register 110. Thus, all of the output terminals Q1 to Qn of the shift register 110 are set to the Low level.

At time t1, the serial data SI is set to the High level prior to the scanning of one line. At time t2, the first pulse SCK1 of the serial clock pulse SCK is inputted. Upon the rising edge of the first pulse SCK1, the serial data SI is input into the first FF 111-1 of the shift register 110 and the output terminal Q1 of the first FF 111-1 goes high (High level) after a short delay time. The serial data SI is again set to the L level at time t3, which is a predetermined time after the first pulse SCK1 has risen.

The High level at the output terminal Q1 of the first FF 111-1 causes the gate potential of the light emitting thyristor 210-1 to increase. At time t4, the ON/OFF command signal DRVON-P goes high (High level), causing the transmission gate 232 to turn off, so that voltage appears across the anode and cathode of the light emitting thyristor 210-1. Thus, the light emitting thyristor 210-1 turns on, the cathode current Ik flowing to emit light.

At time t5, the ON/OFF command signal DRVON-P is set to the Low level, thereby causing the light emitting thyristor 210-1 to turn off. The output signal of the inverter 231 in the switch circuit 230 goes high (High level), causing the transmission gate 232 to turn on. Thus, the anode-cathode voltage of the light emitting thyristor 210-1 becomes about 0 V and the light emitting thyristor turns off.

The light output of each of the light emitting thyristors 210-1 to 210-8 is determined by the cathode current Ik that flows from anode to cathode. Thus, the use of the driver circuit 41 having the constant current circuit 42 maintains the drive current, e.g., Ik at a constant value even if the anode-cathode voltage when the light emitting thyristor turns on varies from thyristor to thyristor.

If the light emitting thyristor 210-1 is not to turn on, the ON/OFF command signal DRVON-P can remain at low. In this manner, the light emitting thyristor is turned on or off depending on the logic state of the ON/OFF command signal DRVON-P.

At time t6, the second pulse SCK2 of the serial clock SCK rises. At this moment, the serial data SI is at the Low level. The output terminal Q1 of the first FF 111-1 goes low (Low level) after a short delay time while the output terminal Q2 of the second FF 111-2 goes high (High level). At time t7, the ON/OFF command signal DRVON-P goes high (High level), which in turn causes the switch circuit 230 to turn off. Thus, the anode-cathode voltage of the light emitting thyristor 210-2 increases and the trigger current flows through the gate of the light emitting thyristor 210-2, causing the light emitting thyristor 210-2 to turn on.

At time t8, the ON/OFF command signal DRVON-P is set to the Low level to turn off the light emitting thyristor 210-2, causing the switch circuit 230 to turn on to set the anode-cathode voltage of the light emitter thyristor 210-2 to substantially 0 V.

In this manner, when one of SCK1, SCK2, SCK3, SCK4, SCK5, SCK6, SCK7, and SCK8 rises, a corresponding one of the outputs Q1, Q2, Q3, Q4, Q5, Q6, Q7, and Q8 of the shift register 110 goes high (High level) and the remaining ones of the outputs Q1, Q2, Q3, Q4, Q5, Q6, Q7, and Q8 remain low (Low level). Therefore, thyristors corresponding to the outputs Q of the High level are selectively turned on to emit light.

In order for the light emitting thyristors to turn on, a voltage sufficient to cause gate current to flow can be applied across the gate and cathode of the thyristors. In order for the light emitting thyristors to turn off, a voltage insufficient to cause gate current to flow can be applied across the gate and cathode of the light emitting thyristors, no voltage can be applied across the gate and cathode, or reverse voltage may be applied across the gate and cathode'.

The light emitting thyristor 210-1 remains turned on during a drive time period T1 and the light emitting thyristor 210-2 remains turned on during a drive time period T2. However, the time periods T1 and T2 may be changed in length, so that dots may be produced by an equal amount of exposing energy even if the amount of light emitted from individual light emitting thyristors varies from thyristor to thyristor.

As described above, the current Io and cathode current Ik flow or do not flow depending on the state of ON/OFF command signal DRVON-P. When the current Io flows, the cathode current Ik does not flow, and vice versa. The current Io and the cathode current Ik are mainly determined by the magnitude of the drive current Iout. In other words, the current that flows through the cable 70 is always Iout which can be regarded as direct current. The transmission gate is ON when the electrical conduction of the light emitting thyristor is to be disabled, and is OFF when the electrical conduction of the light emitting thyristor is to be enabled. The print head 13 shown in FIG. 5 does not suffer from the problem of transition of drive current signals, and hence multiple reflections of signal which would otherwise be caused by the ON and OFF operations of the light emitting thyristors.

{Effects of First Embodiment}

The print head 13 according to the first embodiment eliminates multiple occurrences of signal reflection between the driver circuit 41 and the light emitting thyristors 200 connected through the cable 70, which eliminates the change in the waveform of the drive current that in turn causes the change in exposing energy—hence uneven print density. This operation solves the problem of increased rise time and fall time of the drive current Iout, thereby achieving high speed switching of the light emitting thyristors.

The print head 13 according to the first embodiment provides an image forming apparatus which is excellent in space efficiency and light output efficiency. Although the print head 13 is particularly applicable to the full-color image forming apparatus 1 which employs a multiple of print heads, the print head 13 may also be applicable to monochrome image forming apparatus and multi-color image forming apparatus.

Second Embodiment

{Print Head}

Figure 10:
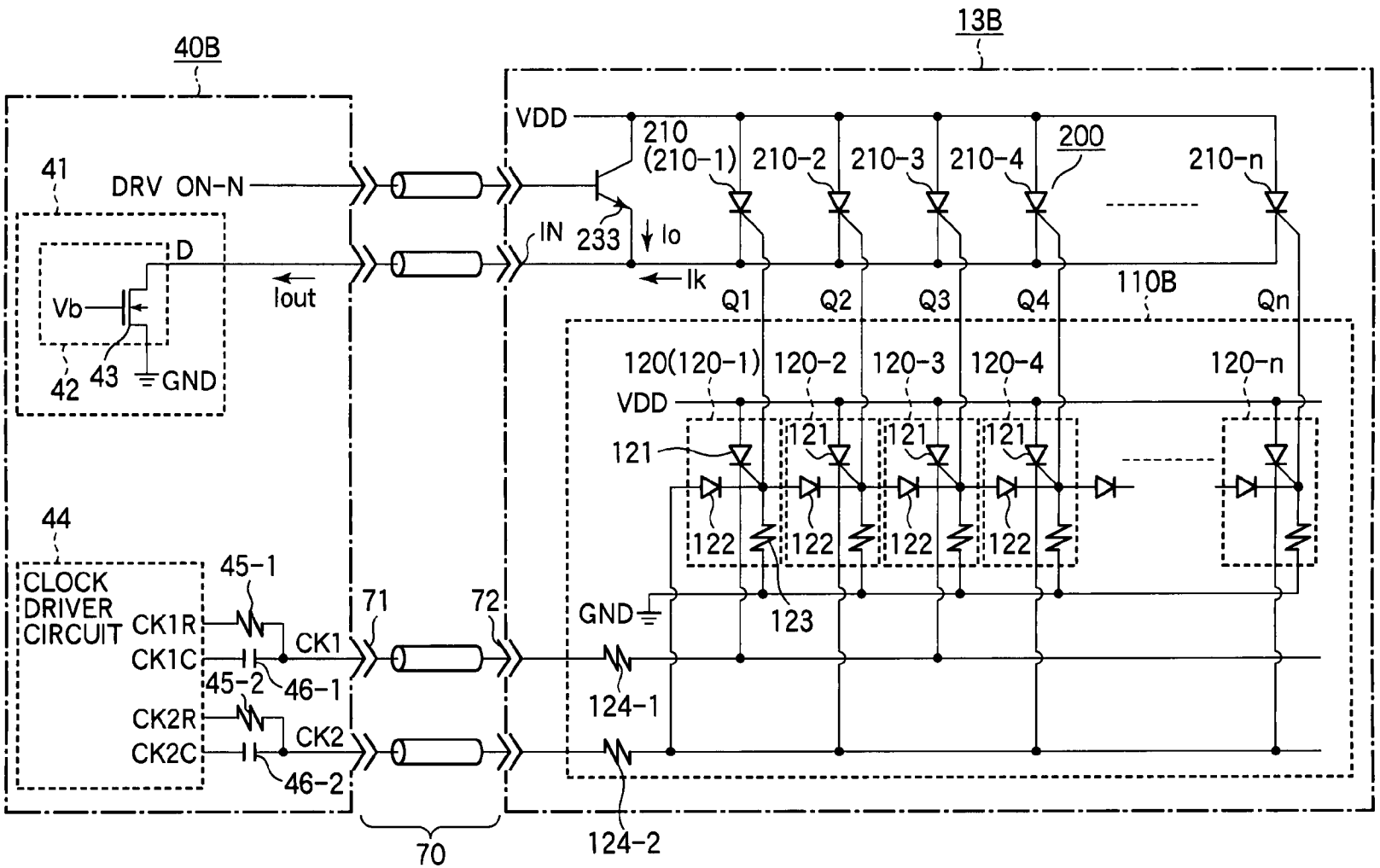
FIG. 10 is a block diagram illustrating the outline of circuits of the printing controller and a print head according to a second embodiment.

FIG. 10 is a block diagram illustrating the outline of circuits of a printing controller and a print head according to the second embodiment.

A cable 70 has connectors 71 and 72, and electrically connects between a printing controller 405 and a print head 13B.

The print head 13B includes a self-scanning shift register 110B which is of a different configuration from the shift register 110 of the first embodiment, arrays of light emitting elements similar to those of the first embodiment, and a switching means (e.g., bipolar NPN transistor) 233 different from the first embodiment.

The print head 13B is constituted of a plurality of stages 120 formed of self-scanning thyristors, and supplies trigger current to the array 200 to turn on a corresponding light emitting thyristor. The self-scanning shift register 110B includes, for example, 4992 stages i.e., 200-1 to 200-4992. Each stage includes a self-scanning thyristor 121 having an anode connected to a VDD terminal, a diode 122 having a cathode connected to the gate of the self-scanning thyristor 121, and a resistor 123 connected across the gate of the self-scanning thyristor 121 and the ground GND. The self-scanning thyristor 121 of each of the odd-numbered stages 120-1, 120-3, 120-5, . . . has an anode connected to the VDD terminal, a cathode connected to the connector 72 through a resistor 124-1, and a gate connected to the ground GND through the resistor 123. The gate of the self-scanning thyristor 121 of the first stage is connected to the cathode of the diode 122 whose anode is connected to the connector 72 through the connector 124-2. The gates of the self-scanning thyristors 121 of adjacent stages are connected via the diode 122. The self-scanning thyristor 121 of each of even-numbered stages 120-2, 120-4, 120-6, . . . has an anode connected to the VDD terminal, a cathode connected to the connector 72 through the resistor 124-2, and a gate connected to the ground GND through the resistor 123. The gate of self-scanning thyristor 121 of each stage is connected to the output Q1, Q2, Q3, Q4, Q5, . . . Qn of the self-scanning shift register 110B.

The self-scanning thyristor 121 in each of stages 120-1, 120-2, 120-3, . . . 120-n has a similar layer structure to the light emitting thyristors 210 of the array 200 of light emitting elements, and operates much the same way as the array 200 of light emitting elements. However, the self-scanning thyristor 121 does not have to emit light and is therefore covered with a metal film from above to block the light. The diode 122 connects between the gates of the self-scanning thyristors in adjacent stages, and determines the order (e.g., leftward in FIG. 10) in which the light emitting thyristors 210-1 to 210-n are turned on sequentially one at a time.

The NPN transistor 233 operates to turn on the array 200 of light emitting elements in response to the ON/OFF command signal DRVON-N, where N implies negative logic. The NPN transistor 233 has a collector connected to the VDD terminal, an emitter connected to a common terminal IN. The whole circuit is fabricated on a GaAs wafer and therefore the MOS transistors of the switch circuit 230 of the first embodiment cannot be fabricated. Thus, the NPN transistor 233 is in a GaAs configuration.

The printing controller 40B includes a circuit (not shown) that supplies the ON/OFF command signal DRVON-N to the print heads 133, a plurality of driver circuits 41, a clock driver circuit 44, and power supply and ground terminals (not shown). The ON/OFF command signal DRVON-N commands the ON and OFF of the array of light emitting elements. The plurality of driver circuit 41 is similar to those of the first embodiment that drive a plurality of arrays of light emitting elements in a time division manner. The clock driver circuit 44 supplies a clock signal to the self-scanning shift register 110B. FIG. 10 shows only one driver circuit 41 for simplicity's sake. The plurality of arrays 200 has a total of, for example, 4992 light emitting thyristors 210-1 to 210-n (e.g., n=4992), which are divided into a predetermined number of groups. The groups are driven in a time division manner, so that any light emitting thyristors to be turned on in each group are driven before those in remaining group are driven.

The following is a typical design. A total of 26 chips of arrays 200 are aligned on the print circuit board 13*b*, each array having 192 light emitting thyristors 210 (i.e., 210-1 to 210-192). Thus, the print head 13 has a total of 4992 (=26×192) light emitting thyristors 210-1 to 210-n (n=4992). The driver circuit 41 has 26 output terminals connected to corresponding arrays 200 of light emitting elements. The driver circuit 41 is capable of driving the arrays 200 in parallel. The driver circuit 41 and clock driver circuit 44 reside within the printer controller 40B shown in FIG. 10.

The clock driver circuit 44 has a plurality of output terminals CK1R, CK1C, CK2R, and CK2C which output clock signals. The output terminals CK1R, CK1C, CK2R, and CK2C are connected to a three-state buffer (not shown). Three-state buffers are a circuit having a CMOS output driver that allows no output state (i.e., a high-impedance state, hereinafter referred to Hi-Z state) in addition to the fundamental Low and High levels, effectively "removing" the output from the circuit.

The output terminals CK1R, CK1C, CK2R, and CK2C are connected to a resistor 45-1, a capacitor 46-1, a resistor 45-2, and a capacitor 46-2, respectively. One end of the resistor 45-1 and one end of the capacitor 46-1 are connected to the output terminals CK1R and CK1C, respectively, and the other end of the resistor 45-1 and the other end of the capacitor 46-1 are connected to a clock terminal CK1. The clock terminal CK1 is connected to the resistor 124-1 on the print head 13 side through the connector 71, cable 70, and connector 72. One end of the resistor 45-2 and one end of the capacitor 46-2 are connected to the output terminals CK2R and CK2C, respectively, and the other end of the resistor 45-2 and the other end of the capacitor 46-2 are connected to a clock terminal CK2. The clock terminal CK2 is connected to the resistor 124-2 on the print head 13 side through the connector 71, cable 70, and connector 72.

{NPN Transistor}

Figure 11A:
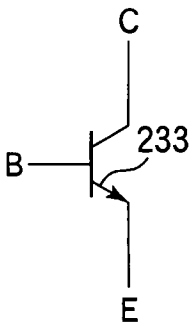
FIG. 11A shows a circuit symbol of an NPN bipolar transistor having a collector, an emitter, and a base.
Figure 11B:
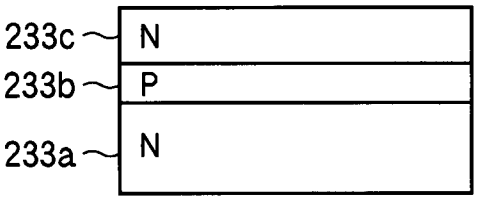
FIGS. 11B and 11C are cross-sectional views of the NPN bipolar transistor.
Figure 11C:
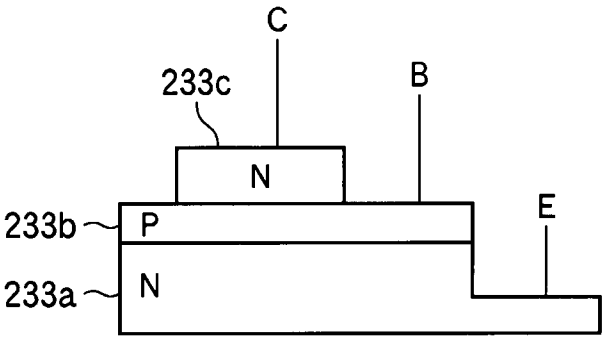

FIGS. 11A-11C illustrate the structure of the NPN transistor 233 shown in FIG. 10.

FIG. 11A shows a circuit symbol of the NPN transistor 233 having a collector C, an emitter E, and a base B.

FIGS. 11B and 11C are cross-sectional views of the NPN transistor 233. The NPN transistor 233 includes an N type layer 233*a*, a P type layer 233*b*, and an N type layer 233*c* which are aligned in this order.

The NPN transistor 233 is fabricated as follows: Referring to FIG. 11B, a buffer layer and a sacrificial layer (not shown) are epitaxially grown on a wafer. A three-layer structure is then formed on the wafer. The three-layer structure includes the N type layer 233*a* formed of AlGaAs doped with an N type impurity, the P type layer 233*b* doped with a P type impurity, and the N type layer 233*c* doped with an N type impurity. Grooves are formed in the three-layer structure by a known etching method to define individual devices. Each device is subjected to further etching to expose a part of the N type layer 233*a*, and a metal wiring is then formed on the exposed area which is to function as the emitter E. At the same time, a base electrode and a collector electrode are formed on the P type layer 233*b* and the N type layer 233*c*.

{Brief Description of Printing Controller and Print Head}

Referring to FIG. 10, when the printing controller 40B outputs the ON/OFF command signal DRVON-N of the High level, the ON/OFF command signal DRVON-N causes base current to flow into the base-emitter junction of the NPN transistor 233 through the connector 71, cable 70, and connector 72, thereby turning on the NPN transistor 233. Collector current Io flows through the NPN transistor 233 from collector to emitter, causing the cathode voltage of the light emitting thyristor 210 to rise. As the cathode voltage rises, the anode-cathode voltage of the light emitting thyristor 210-1 decreases and cathode current Ik decreases to zero. This causes all of the light emitting thyristors 210-1 to 210-n to turn off.

When the printing controller 40B outputs the ON/OFF command signal having a Low level, no base current flows through the base-emitter junction of the NPN transistor 233. A power supply voltage VDD is applied to the anode of the light emitting thyristor 210. An NMOS transistor 43 is connected to the cathode of the light emitting thyristor 210 through the connector 72, cable 70, connector 71, and data terminal D. The transistor 43 is substantially in its conducting region, pulling down the voltage of the cathode so that a voltage of substantially equal to the power supply voltage VDD is applied across the anode and cathode of the light emitting thyristor 210. At this moment, if the gate of a light emitting thyristor 210 receives a High level signal, the Light emitting thyristor 210 is triggered to turn on.

The cathode current Ik that flows from anode to cathode of the light emitting thyristor 210 is equal in magnitude to the drive current Iout that flows into the data terminal D. Thus, the light emitting thyristor 210 turns on to emit light in accordance with the drive current Iout.

{Detailed Description of Printing Controlled and Print Head}

Figure 12:
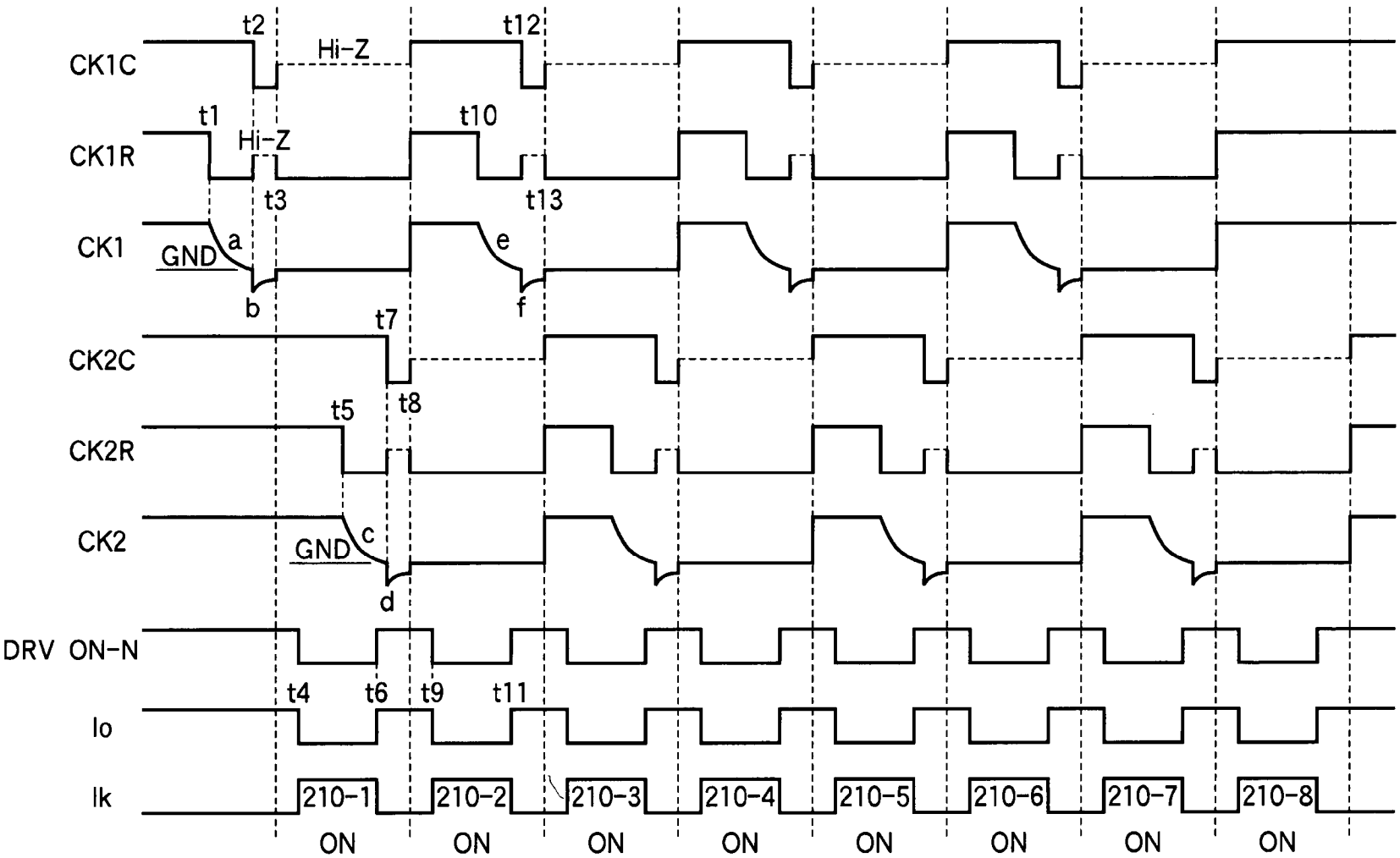
FIG. 12 is a timing chart illustrating the details of the operation of the print head and the printing controller shown in FIG. 10.

FIG. 12 is a timing chart illustrating the details of the operation of the print head 13B and the printing controller 40B shown in FIG. 10.

FIG. 12 illustrates the waveform of signals when the light emitting thyristors 210-1 to 210-8 shown in FIG. 10 are sequentially turned on one at a time during the printing operation of the image forming apparatus shown in FIG. 1.

The self-scanning shift register 110B using the self-scanning thyristor 121 is clocked by a two-phase clock supplied from the clock terminals CK1 and CK2 of the clock driver circuit 44. The clock driver circuit 44 has the clock terminals CK1C and CK1R for clocks in one of two phases and the clock terminals CK2 and CK2R for clocks in the other of the two phases. The clock terminals CK1R, CK1C, CK2R, and CK2C are driven by a three-state buffer includes a CMOS output driver that allows no output state (Hi-Z state) in addition to the fundamental low level and High level, effectively "removing" the output from the circuit.

Referring to FIG. 12, the output terminals CK1C, CK1R, CK2C, and CK2R are initially at the High level.

The output terminals CK1R and CK1C are connected to the clock terminal CK1 through the resistor 45-1 and capacitor 46-1, respectively, and the output terminals CK2R and CK2C are connected to the clock terminal CK2 through the resistor 45-2 and capacitor 46-2 to the clock terminal CK2, respectively. Thus, the clock terminals CK1 and CK2 are initially at the High level in FIG. 12, and the cathodes of the self-scanning thyristors 121 of the odd-numbered stages of the self-scanning shift register 110B are at the High level and the cathodes of the self-scanning thyristors 121 of the even-numbered stages are at the High level. In other words, all of the self-scanning thyristors are off.

At this moment, the ON/OFF command signal DRVON-N is at the High level and the NPN transistor 233 is ON so that the current Io is substantially equal to the drive current Iout, and the light emitting thyristors 210-1 to 210-8 are off decreasing the cathode current Ik.

A description will be given of how the self-scanning thyristors 121 of the odd-numbered stages are turned on.

First Stage of Shift Register

Referring to FIG. 12, at time t1, the output terminal CK1R of the clock driver circuit 44 is set to the Low level. Current flows from the output terminal CK1C to the output terminal CK1R through the capacitor 46-1 and the resistor 45-1, charging the capacitor 46-1 to cause the voltage across the capacitor 46-1 to increase. Accordingly, the potential at the clock terminal CK1 decreases toward the ground GND as depicted at "a".

At time t2, the output terminal CHIC is set to the Low level, so that the output terminal CK1R enters the Hi-Z state as depicted by a dotted line and is at a mid potential between the High level and the Low level. Since the CMOS output driver CMOS enters the Hi-Z state at time t2, a waveform having undershoot appears on the clock terminal CK1 as depicted at "b" in FIG. 12. This undershoot is caused by the voltage that charges the capacitor 46-1.

The three-state output buffer (not shown) in the clock driver circuit 44 shown in FIG. 10 has a parasitic diode. The undershoot waveform causes current to flow through the parasitic diode so that the negative voltage at "b" is clamped. This maintains the negative peak of the undershoot waveform at "b" at about −0.6 V. The capacitor 46-1 then discharges gradually so that the voltage across the capacitor 46-1 gradually decreases. Thus, the undershoot waveform depicted at "b" will decay with time.

The undershoot waveform at "b" that appears on the clock terminal CK1 applies a relatively high voltage across the anode and cathode of the thyristor 121 of the first stage 120-1. At this time, the clock terminal CK2 is at the High level, so that trigger current flows into the gate of the thyristor 121 through the diode 122 of the first stage 120-1. Thus, the thyristor 121 turns on, and remains on until the cathode voltage at the clock terminal CK1 goes high (High level).

At time t3, the output terminal CK1C is set to the Hi-Z state and therefore the clock terminal CK1 goes low (Low level), reaching a potential substantially equal to the ground GND.

At time t4, the ON/OFF command signal DRVON-N is set to the Low level, and the NPN transistor 233 goes off. Since the NMOS transistor 43 is in a saturation region thereof, the data terminal D remains low. The thyristor 121 of the first stage 120-1 is in the ON state, the voltage across the cathode and gate of the thyristor 121 being nearly equal to the forward voltage. The gate potential of the thyristor 121 is higher than the cathode potential.

The thyristor 121 of the first stage 120-1 and the light emitting thyristor 210-1 have their gates connected together, and therefore trigger current flows through the gate of the thyristor 210-1 to turn on the light-emitting thyristor 210-1. The light emitting thyristor 210-1 remains on until the ON/OFF command signal DRVON-N goes high (High level) to turn on the NPN transistor 233.

Second Stage of Shift Register

At time t5, the output terminal CK2R is set to the Low level. Current flows from the output terminal CK2C to the output terminal CK2R through the capacitor 46-2 and the resistor 45-2, charging the capacitor 46-2 to cause the voltage across the capacitor 46-2 to increase. Accordingly, the potential at the clock terminal CK2 decreases toward the ground GND as depicted at "c".

At time t7, the output terminal CK2C is set to the Low level, so that the output terminal CK2R enters the Hi-Z state as depicted by a dotted line and is at a mid potential between the High level and the Low level. Since the CMOS output driver CMOS enters the Hi-Z state at time t7, a waveform having undershoot appears on the clock terminal CK2 as depicted at "d" in FIG. 12. This undershoot is caused by the voltage that charges the capacitor 46-2. The three-state output buffer (not shoarasitic diode sown) in the clock driver circuit 44 shown in FIG. 10 has a parasitic diode. The undershoot waveform causes current to flow through the p that the negative voltage at "d" is clamped. This maintains the negative peak of the undershoot waveform at "d" at about −0.6 V. The capacitor 46-2 discharges gradually so that the voltage across the capacitor 46-2 gradually decreases. Thus, the undershoot waveform depicted at "d" will decay with time.

The undershoot waveform at "d" that appears on the clock terminal CK2 applies a relatively high voltage across the anode and cathode of the thyristor 121 of the second stage 120-2. At this time, the clock terminal CK2 is at the High level while the thyristor 121 of the first stage remains ON, so that the gate potential of the thyristor 121 of the first stage remains high. Thus, trigger current flows into the gate of the thyristor 121 of the second stage through the diode 122 of the second stage 120-2. Thus, the thyristor 121 of the second stage turns on, and remains on until the cathode voltage at the clock terminal CK2 goes high (High level).

At time t8, the output terminal CK2C is set to the Hi-Z state and the clock terminal CK2R goes low (Low level), reaching a potential substantially equal to the ground GND. The output terminals CK1C and CK1R are both at the High level, and the clock terminal CK1 goes high (High level). As a result, the thyristor 121 of the first stage 120-1 turns off.

At time t9, the ON/OFF command signal DRVON-N for the thyristor 210-2 is set to the Low level, and the NPN transistor 233 goes off. Since the NMOS transistor 43 is in a saturation region thereof at this moment, the data terminal D remains low. The thyristor 121 of the second stage 120-2 is in the ON state, the cathode-gate voltage of the thyristor 121 being nearly equal to the forward voltage. Thus, the gate potential of the thyristor 121 is higher than the cathode potential.

The thyristor 121 of the second stage 120-2 and the light emitting thyristor 210-2 have their gates connected together, and therefore trigger current flows through the gate of the light emitting thyristor 210-2 to turn on the light emitting thyristor 210-2. The light emitting thyristor 210-2 remains on until the ON/OFF command signal DRVON-N goes high (High level) to turn on the NPN transistor 233.

Third Stage of Shift Register

At time t10, the output terminal CK1R is set to the Low level. Current flows from the output terminal CK1C to the output terminal CK1R through the capacitor 46-1 and the resistor 45-1, charging the capacitor 46-1 to cause the voltage across the capacitor 46-1 to increase. Accordingly, the potential at the clock terminal CK1 decreases toward the ground GND as depicted at "e".

At time t12, the output terminal CK1C is set to the Low level, so that the output terminal CK1R enters the Hi-Z state as depicted by a dotted line and is at a mid potential between the High level and the Low level. Since the output terminal CK1R enters the Hi-Z state at time t17, a waveform having undershoot waveform appears on the clock terminal CK1 as depicted at "f" in FIG. 12. This undershoot waveform is caused by a voltage that charges the capacitor 46-1.

The three-state output buffer (not shown) in the clock driver circuit 44 shown in FIG. 10 has a parasitic diode. The undershoot waveform causes current to flow through the parasitic diode so that the negative voltage at "f" is clamped. This maintains the negative peak of the undershoot waveform at "f" at about −0.6 V. The capacitor 46-1 discharges gradually so that the voltage across the capacitor 46-1 gradually decreases. Thus, the undershoot waveform depicted at "f" will decay with time.

The undershoot waveform depicted at "f" that appears on the clock terminal CK1 applies a relatively high voltage across the anode and cathode of the thyristor 121 of the third stage 120-3. At this time, the clock terminal CK1 is at the High level while the thyristor 121 of the second stage remaining ON, so that the gate potential of the thyristor 121 of the second stage remains high. Thus, trigger current flows into the gate of the thyristor 121 of the third stage through the diode 122 of the third stage 120-3. Thus, the thyristor 121 of the third stage turns on, and remains on until the cathode voltage at the clock terminal CK1 goes high (High level).

At time t13, the output terminal CK1C is set to the Hi-Z state and the clock terminal CK1R goes low (Low level). Thus, the clock terminal CK1 reaches a potential substantially equal to the ground GND. At the same time, the output terminals CK2C and CK2R are both at the High level, and the clock terminal CK2 goes high (High level). As a result, the thyristor 121 of the second stage 120-1 turns off.

As described above, the two clock signals outputted from the clock terminals CK1 and CK2 are identical in waveform but different in phase. The odd-numbered clock signal outputted from the clock terminals CK1 is supplied to the thyristors 121 of the odd-numbered stages 120-1, 120-3, 120-5, and 120-7 in sequence, and the even-numbered clock signal outputted from the clock terminals CK2 is supplied to the thyristors 121 of the even-numbered stages 120-2, 120-4, 120-6, and 120-8 in sequence, so that the thyristors 121 are turned on one at a time in order.

The gate of the thyristors 121 which remain turned on are at about the High level, and the gate of the thyristors 121 which remain turned off are at about the Low level, nearly ground level GND. The gate potential of the thyristor 121 is supplied from the output terminals Q1-Q8 of the shift register 110B. Thus, the light emitting thyristors 210-1 to 210-8 can be turned on in sequence one at a time in accordance with the command signals from the shift register 110B.

As is clear from FIG. 12, the currents Io and Ik have waveforms complementary to each other such that when the current Io flows, the current Ik is about zero and vice versa. The sum of the currents Io and Ik is equal to the current Iout. As a result, current that does not vary with time flows through the data terminal D of the driver circuit 44 and is independent from the ON or OFF state of the light emitting thyristors 210-1 to 210-8. This circuit operation eliminates the chance of transitional signals of flowing through the cable 70; hence distortion of the current waveforms and prolonged transitional times of the light emitting thyristors can be minimized.

The comparative example shown in FIG. 7 presents a problem in that current flows intermittently through the cable 70 as the light emitting thyristors 210-1 to 210-8 turn on and off, causing multiple reflections of signal to occur between the driver circuit 44A and the print head 13A, and hence distortion of the current waveforms and prolonged transition time of the light emitting thyristors.

{Effects of Second Embodiment}

The second embodiment provides the following effects.

The print head 13B according to the second embodiment includes the driver circuit 41 and arrays 200 of light emitting elements which are implemented on circuit boards independent from each other. The cables 70 electrically connect the driver circuit 41 and the arrays 200 of light emitting thyristors. This eliminates the drawback in that multiple reflections of signals between the driver circuit 41 and the arrays 200 of light emitting elements cause variations of the waveform of drive current and hence variations of exposure energy leading to uneven print density. The second embodiment also solves the problem of increased rise time and fall time of the drive current Iout, thereby achieving the high speed switching operation of the light emitting thyristors 210.

In addition, an image forming apparatus 1 which is excellent in the space efficiency and light output efficiency can be obtained.

{Modification}

The present invention is not limited to the above-described first and second embodiments but may be modified in a variety of ways, including the following modifications.

While the first and second embodiments have been described in terms of an exposing unit incorporating light emitting thyristors 210, the present invention may be applicable to devices that controllably supply power supply voltage to elements such as electroluminescence (EL) elements, heat generating resistors, and display elements, which are connected in series with the thyristors. For example, the invention may be applicable to a printer that employs an organic EL print head implemented with the arrays of organic. EL elements, a thermal printer that employs heat generating resistors, and a display apparatus that includes display elements.

The invention may also be applicable to thyristors used as switching elements for driving display elements (e.g., display elements arranged in a in a line or matrix).

The invention may also be applicable not only to three-terminal thyristors but also to four-terminal thyristors or silicon semiconductor controlled switch (SCS).

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A driver circuit for driving a plurality of switch elements connected between a power supply terminal and a common terminal, each switch element including a first terminal connected to the power supply terminal, a second terminal connected to the common terminal, and a third terminal that controls electrical conduction between the first terminal and the second terminal, the driver comprising:

a switch circuit connected between the power supply terminal and the common terminal, the switch circuit being in parallel with the plurality of switch elements, and the switch circuit electrically connecting or disconnecting the power supply terminal and the common terminal in response to a control signal, wherein when at least one of the plurality of switch elements is conducting, the switch circuit opens to disconnect the power supply terminal from the common terminal and when none of the plurality of switch elements is conducting, the switch circuit closes to connect the power supply terminal to the common terminal;

a driver into which either current through the switch circuit flows or current through the switch elements flows; and a transmission line having a specific characteristic impedance, connected between the common terminal and the driver.

2. The driver circuit according to claim 1, wherein when the switch circuit is closed, the electrical conduction of the switch elements is disabled, and when the switch circuit is opened, the electrical conduction of the switch elements is enabled.

3. The driver circuit according to claim 1, wherein the driver allows current of a constant magnitude to flow therethrough.

4. The driver circuit according to claim 1, wherein the switch elements are light emitting thyristors, and the switch circuit is a transmission gate switchable between an ON state and an OFF state in response to the control signal.

5. The driver circuit according to claim 1, wherein the switch elements are light emitting thyristors, and the switch circuit is a bipolar transistor that switches between an ON state and an OFF state in response to the control signal.

6. A driver apparatus comprising:

the driver circuit according to claim 1; and a shift register configured to output a trigger signal to the third terminal of each switch element, the trigger signal causing the switch element to electrically connect the first terminal and the second terminal.

7. The driver apparatus according to claim 6, wherein the shift register is configured to transfer a data signal inputted thereinto, the shift register including a plurality of cascaded flip-flops through which the data signal is shifted upon each pulse of a serial clock signal, each of the flip flops providing a trigger signal to the third terminal of a corresponding one of the switch elements to enable electrical conduction between the first terminal and the second terminal of the corresponding one of the switch elements.

8. The driver apparatus according to claim 6, wherein the shift register includes a self-scanning circuit configured of three-terminal switch elements, wherein upon receipt of the serial clock signal, the self-scanning circuit provides the trigger signal to the third terminal of the corresponding one of the switch elements.

9. The driver apparatus according to claim 8, wherein the three-terminal switch elements are thyristors.

10. The driver apparatus according to claim 6 incorporated in a print head.

11. The driver apparatus according to claim 10 incorporated in an image forming apparatus.

12. The driver apparatus according to claim 1, wherein the power supply terminal is a first power supply terminal and the transmission line includes a first line end and a second line end, the first line end being connected to the common terminal, wherein the driver is a constant current source and includes a fourth terminal connected to the second line end and a fifth terminal connected to a second power supply terminal, wherein when any one of the plurality of switch elements is conducting, the current through the switch element flows through the common terminal, the transmission line, and the constant current source to the second power supply terminal in this order, and wherein when none of the plurality of switch elements is conducting, the current through the switch circuit flows through the common terminal, the transmission line, and constant current source to the second power supply terminal in this order.

13. The driver apparatus according to claim 12, wherein the transmission line is a cable.

14. The driver apparatus according to claim 13, wherein the second power supply terminal is connected to the ground.

* * * * *